US005565875A

United States Patent [19]

Buralli et al.

[11] Patent Number: 5,565,875

[45] Date of Patent: Oct. 15, 1996

[54] THIN BROADBAND MICROSTRIP ANTENNA

[75] Inventors: Bernard Buralli, Cannes la Bocca; Lucien Jouve, La Roquette sur Siagne; Marcel Sauvan, Le Cannet, all of France

[73] Assignee: Societe Nationale Industrielle et Aerospatiale, France

[21] Appl. No.: 435,273

[22] Filed: May 5, 1995

Related U.S. Application Data

[63] Continuation of Ser. No. 71,178, Jun. 2, 1993, abandoned.

[30] Foreign Application Priority Data

Jun. 16, 1992 [FR] France ..... 92 07274

[51] Int. Cl.[6] ..... H01Q 1/38

[52] U.S. Cl. ..... 343/700 MS; 343/769; 343/846

[58] Field of Search ..... 343/700 MS, 769, 343/767, 768, 846, 848; H01Q 1/38, 13/12

[56] References Cited

U.S. PATENT DOCUMENTS

| | | | |
|---|---|---|---|
| 4,060,810 | 11/1977 | Kerr et al. | 343/700 MS |
| 4,157,548 | 6/1979 | Kaloi | 343/700 MS |
| 4,160,976 | 7/1979 | Conroy | 343/700 MS |
| 4,208,660 | 6/1980 | McOwen, Jr. | 343/769 |
| 4,320,402 | 3/1982 | Bowen | 343/769 |
| 4,947,178 | 8/1990 | Shafai | 343/769 |
| 4,987,421 | 1/1991 | Sunahara et al. | 343/700 MS |
| 5,323,168 | 6/1994 | Itoh et al. | 343/700 MS |

FOREIGN PATENT DOCUMENTS

| | | | |
|---|---|---|---|
| 1136267 | 11/1982 | Canada | 343/769 |
| 403262307 | 11/1991 | Japan | H01Q 1/38 |
| 2202091 | 9/1988 | United Kingdom . | |

OTHER PUBLICATIONS

IEE Proceedings H. Microwaves, Antennas & Propagation, vol. 138, No. 2 Apr. 1991, pp. 185–191.

NASA Tech Brief NTN–77/0801 1976, 'Low–Cost Dual–Frequency Microwave Antenna'.

*Primary Examiner*—Hoanganh Le

[57] ABSTRACT

An elementary antenna embodies a constant thickness dielectric substrate having on one side a conductive metal layer forming a ground plane and on its other side a radiating patch electrically connected to a feed line. The patch is formed by a conductive loop of constant width l surrounding an inner parasitic patch which is not fed and is separated from the inner parasitic patch by a closed continuous slot of constant width e adapted to bring about coupling between the loop and the inner parasitic patch.

13 Claims, 7 Drawing Sheets

THIN BROADBAND MICROSTRIP ANTENNA

This is a continuation of application Ser. No. 08/071,178, filed Jun. 2, 1993, now abandoned.

BACKGROUND OF THE INVENTION

1. Field of the Invention

The invention concerns a thin broadband microstrip antenna.

2. Description of the Prior Art

A radio frequency electromagnetic wave characterized among other things by its wavelength λ (the speed of light divided by the frequency of the transmitted signal), conveying energy and usually information, can propagate in various media the most important of which are:

guided propagation media for example, cables, lines, waveguides, etc; and free space propagation media, for example homogeneous or non-homogeneous, isotropic or non-isotropic free space, etc.

An antenna may be regarded as an interface between these two types of media enabling partial or total transfer of electromagnetic energy from one to the other. A transmit antenna passes this energy from a guided propagation medium to a free space propagation medium and a receive antenna reverses the direction of energy transfer between the media. The following description usually refers implicitly to a transmit antenna. However, the principle of equivalence guarantees reciprocity of all stated properties with a receive antenna.

The expression antenna feed circuit(s) or device refers to all component parts of all or part of the guided propagation medium directing or collecting the electromagnetic energy to be transferred and embodying passive or active, reciprocal or non-reciprocal components.

An elementary antenna is often associated with one or more geometrical points called phase centers from which the electromagnetic wave appears to emanate for a given direction in the case of a transmit antenna.

Antenna resonance occurs at the frequency or frequencies at which the transfer of energy transmitted from the feed line to free space via the antenna is optimum; in mathematical terms, at the resonant frequency fr the complex impedance Z at the antenna input has a null imaginary part and a maximal real part.

In microwave technology it is usual to represent the locus of the impedances Z (as a function of frequency) on a SMITH chart on which each resonance appears as a loop.

Using current measuring techniques this resonance is "seen" through the matching arrangement which characterizes the transfer of energy from the feed line to the antenna. This view of the antenna behavior may be called the antenna response and is quantified in terms of return losses or the voltage standing wave ratio (VSWR) as defined below.

If Z is the impedance at the point at which matching is measured and Zc is the characteristic impedance of the feed line (according to the standard usually adopted Zc=50 Ohms), then if z=Z/Zc the return loss is the complex ratio:

$$\rho=(z-1)/(z+1)$$

The VSWR is then defined as:

$$VSWR=|(1+|\rho|)/(1-|\rho|)|$$

The antenna is characterized by a number of performance indicators including:

the voltage standing wave ratio (VSWR) which allows for the quality of matching, i.e. the quantity of energy transmitted from the feed line to the antenna (the better this quality the closer the VSWR is to unity);

the radiation diagram representing the spatial distribution of the electromagnetic field E of the wave; and associated conventional parameters (gain, directivity, efficiency, −3 dB aperture, coverage probability).

The radiation diagram is conventionally represented in a frame of reference centered at a point on the antenna (its phase center if possible) and shown as "cross sections" in a standardized system of spherical coordinates (θ, ϕ). A so-called "constant ϕ" cross section is the curve of variation in the field E projected onto a given polarization (either Eθ or Eϕ), θ varying from 0° to 180° (or from −180° to +180°). Likewise, a so-called "constant θ" cross section is the curve of variation in the field E projected onto a given polarization (either Eθ or Eϕ) with θ varying from 0° to 360°.

An association of elementary antennas is called an antenna array if their feed circuits have common parts or if, because of coupling between the elementary antennas, the overall radiation diagram of the array in a given frequency range depends on that of each of the antennas or radiating elements.

The array obtained by the arrangement of antennas similar to one or more elementary antennas on a given surface is often called an array antenna, usually implying a concept of geometrical repetition of the elementary antennas.

Array antennas are usually employed to obtain a radiation diagram that is highly directive in a given direction relative to the array.

The spacing Δ between the phase centers of the elementary antennas of the array divided by the wavelength $\lambda_o$ in air or in vacuum is often a critical parameter.

For example, for values of $\Delta/\lambda_o>0.5$ the occurrence of significant grating lobes outside the wanted radiation area penalizes the energy transmission balance in the free space propagation medium.

The microstrip technology entails stacking a plurality of layers of conductive or dielectric materials such as, for example, a dielectric substrate layer (glass, PTFE, for example) coated on its lower surface (or I surface) with a conductive film (copper, gold, etc) known as the ground plane and carrying on its upper surface (or S surface) a discontinuous conductive film forming a given geometrical pattern made up of what are usually called patches.

This system can either guide an electromagnetic wave (microstrip line), or radiate an electromagnetic field (microstrip antenna).

The medium in which surface currents propagate is either the air-substrate interface, or the air-conductor-substrate interface.

In the former case the "effective" dielectric constant of the medium may be defined as:

$$\epsilon_e=\frac{\epsilon_r+1}{2}$$

where $\epsilon_r$ is the dielectric constant of the substrate (cf MICROSTRIP ANTENNAS by I. J. BANL and P. BHARTIA, ARTECH HOUSE, 1980).

In the second case:

$$\epsilon_e = \frac{\epsilon_r + 1}{2} + \frac{\epsilon_r - 1}{2} \frac{1}{\sqrt{\left(1 + 12\frac{h}{w}\right)}}$$

where h is the substrate thickness and w is the width of the conductor strip.

Various types of (possibly active) components or other elements may usually be provided on the S side of the structure.

By definition a microstrip antenna is a geometrically shaped element of conductive material on the S side of a dielectric layer. A rectangular or circular shape is often chosen for the following reasons:

the radiation diagram is then largely predictable; and the sizing of these elements to resonate at a given frequency is well understood.

A rectangular microstrip patch is to some extent similar to two parallel slots coincident with two radiating edges of the rectangle. The edges of a rectangular patch which must radiate (and conversely those which must not radiate) are selected by an appropriate choice of the part of the rectangle which is connected to the feed circuit.

A rectangular patch is usually fed near or on the median line joining the sides to be made to radiate. The mode excited in the resonator then produces a good quality linear polarization. The direction of this polarization is perpendicular to the radiating edge of the patch.

This connection may be made through the dielectric substrate or at the periphery of the patch by a microstrip line on the S side (the expression coplanar feed is sometimes used) as described in French Patent No. 2,226,760, among others.

It is essentially the distance L between these edges (known as the "length" of the patch) which determines the antenna resonant frequency.

Appropriate equations and nomograms have been produced.

In MICROSTRIP ANTENNAS by I. J. BAHL and P. BHARTIA, ARTECH HOUSE, 1980, it is stated that to resonate at the frequency fr a rectangular patch must have a length L such that:

$$L = \frac{1}{2 \cdot \lambda_o \cdot \sqrt{(\epsilon_e)}} + 0.412 \frac{(\epsilon_e + 0.3)(W + 0.264 \cdot h)}{(\epsilon_e - 0.258)(W + 0.8 \cdot h)} \quad (1)$$

where:

$$\epsilon_e = 0.5 \cdot (\epsilon_r + 1) + 0.5 \cdot (\epsilon_r - 1) / \sqrt{(1 + 12 \cdot h/W)} \quad (2)$$

$\epsilon_e$ is the dielectric constant of the dielectric substrate, h is the height (or thickness) of the substrate, $\lambda_o$ is the wavelength in air at the frequency fr (i.e, the speed of light divided by this frequency), and W is the width of the patch, according to the above work, for example, defined by the equation:

$$W = \frac{1}{\lambda_o \sqrt{2(\epsilon_r + 1)}}$$

The choice of the width W conditions to a large degree the quality of the radiation, i.e. its efficiency and its form (radiation diagram).

The above work also indicates that the radius R of a circular patch is given by the equation:

$$R = K / \sqrt{\left\{ 1 = \frac{2h}{\pi \cdot \epsilon_r \cdot K} \cdot \left[ \log\left( \frac{\pi \cdot K}{2h} \right) + 1.7726 \right] \right\}} \quad (4)$$

where:

$$K = 8.794 / (f_r \sqrt{\epsilon_r}) \quad (5)$$

Any microstrip patch may be used as an element of an array of the following types:

serial, parallel, or a combination of serial and parallel.

This technology produces antennas (or antenna arrays) that are thin, light in weight, of low cost (quick and easy to manufacture), and able to be "conformed" to apply them to structures that are cylindrical, conical, and the like.

The microstrip antenna is an electronic resonator which is designed to have a high Q. Because of this, antennas using this technology always have a small bandwidth, i.e. resonance occurs in a localized manner only at the frequency for which the antenna is sized and at frequencies very near this frequency.

For example, a conventional rectangular microstrip antenna sized to resonate at 1 600 MHz on a 1 mm thick substrate with dielectric constant $\epsilon r$=2.2 is usable only in a frequency band whose width is in the order of 1% of the resonant frequency, which is insufficient for most applications (telemetry, etc).

Various methods have previously been proposed to overcome this problem. They are reviewed in the article "BANDWIDTH EXTENSION TECHNIQUES IN PRINTED CONFORMAL ANTENNAS", A. HENDERSON, J. R. JANES and C. M. HALL (Military Microwaves 1986).

The simplest way to increase the antenna bandwidth is to make the dielectric layer thicker. If the resonant structure is regarded as a cavity whose (magnetic) walls are:

1–the conductive surface of the patch;

2–the part of the ground plane equivalent to the perpendicular projection of this surface onto the ground plane; and 3–the magnetic walls coincident with the edges of the patch through the thickness of the substrate and whose height is equal to this thickness, then thickening the dielectric layer amounts to lengthening the magnetic walls, which tends to increase the bandwidth of the cavity.

This method has the following drawbacks:

small increase in bandwidth;

increased ohmic losses in the substrate;

generation of surface waves; and increased antenna overall size.

The concept most often used is to stack radiating elements that are not fed (with their associated dielectric layer) on the fed element. These elements are called "parasitic elements". Each of these elements i is sized to resonate at a frequency Fi near the frequency Fa of the fed element. Electromagnetic coupling between these elements and the fed elements causes transfer of energy to the "parasitic elements". The overall frequency response is the envelope of the responses of each element.

This so-called multilayer structure and structures derived from it have the following disadvantages:

- increased thickness, which may be unacceptable if the antenna is required to be thin, especially if it must be conformed (aerospace applications, launch vehicles);
- mechanical inconsistencies and discontinuities affecting the performance of the antenna if it is subject to mechanical or thermal stress (antenna on aircraft, missiles or satellites); and
- problems in manufacturing the antenna respecting the dimensions and relative positions of the various layers (affecting the radio frequency performance).

There thus remains in some applications the requirement to develop a single layer (i.e. only one dielectric layer) structure broadband antenna which avoids the above drawbacks.

It has already been proposed to place two rectangular parasitic patches along non-radiating sides of a fed rectangular patch, or even four rectangular parasitic patches along sides of this patch, in order to enable strong coupling between the facing sides of these patches. Reference may be had to the document WO-89/07838 or to the article "Non-radiating Edges and Four Edges Gap-Coupled Multiple Resonator Broad Band Microstrip Antennas" by G. KUMAR and K. C. GUPTA published in I.E.E.E. Transactions on Antennas and Propagation, Vol. AP 33 n° 2, February 1985. There are preferably four parasitic patches whose dimensions are at least similar to the central patch.

An array of such antennas is obtained by reproducing periodically along one or even two directions in a plane groups of three (or preferably five) patches of which only one is fed, which raises problems of overall size: it is difficult, for example, to satisfy a spacing constraint such as $\Delta<0.5\ \lambda_o$ since between two fed patches there are two parasitic patches separated by a substantial gap; also, the feed can only be via a line in a sub-layer under the ground plane (see in particular the reference WO-89/07838 which is the only one of the aforementioned two documents to make express provision for producing an array of this kind). The geometrical and mechanical problems inherent to the multilayer technique are therefore just as prevalent.

The same type of drawbacks, among others, are encountered with the concepts proposed by U.S. Pat. No. 4,933,680 and British Patent 2,067,842.

Another prior proposal (cf summary in the article cited above) is an annular microstrip patch yielding a bandwidth which is three times the bandwidth obtained from a solid microstrip disk. This concept has the following drawbacks, however:

- the outside diameter of the ring is much larger than that of the corresponding disk (i.e. the disk having the same resonant frequency), which means that this concept is incompatible with the requirement for a small distance between phase centers (for example $\Delta/\lambda_o<0.5$);
- the large bandwidth is obtained only with a specific excitation mode (TM12) requiring the source of energy to be connected to very precise points on the annulus, at precise distances from its inner and outer edges: this type of feed is not compatible with the requirement for a coplanar feed.

An object of the present invention is to alleviate the above-mentioned drawbacks by proposing an elementary antenna patch combining the following advantages:

- increased bandwidth as compared with prior art patches of equivalent overall size;
- small overall thickness (in particular, thin dielectric);
- feasibility of single-layer structure (i.e. single layer of dielectric) and multilayer structure;
- possibility of conforming the antenna with acceptable mechanical strength;
- possibility of using a coplanar feed array, i.e. an array on the same side of the circuit as the radiating patches;
- in the array, possibility of conforming to severe spacing constraints (for example: $\Delta/\lambda_o<0.5$) for the phase centers of the elements required for reasons concerned with overall size or with better control of the radiation diagram;
- easy manufacture.

SUMMARY OF THE INVENTION

In one aspect, the invention resides in an elementary antenna embodying a constant thickness dielectric substrate having on one side a conductive metal layer forming a ground plane and on its other side a radiating patch electrically connected to a feed line, wherein the patch is formed by a conductive loop of constant width surrounding an inner parasitic patch which is not energized and is separated from the inner parasitic patch by a closed continuous slot of constant width e adapted to bring about coupling between the loop and the inner parasitic patch.

Note that an elementary patch of this kind is essentially different to the disclosure of U.S. Pat. No. 4,771,291 which concerns a double frequency microstrip antenna patch.

Starting from the known small bandwidth of prior art microstrip antenna patches, this Patent (the '291 reference) firstly teaches that resonance is not achieved in practice over a continuous band but rather at two or more discrete frequencies. This reference is thus not concerned with obtaining a large bandwidth, which is in itself sufficient to distinguish it from the invention.

Further, the '291 reference uses a mode of excitation which is peculiar to it in the sense that the radio frequency signals are applied to the ground plane, which is entirely incompatible with the principle of a coplanar feed.

Further, the '291 Patent teaches the provision of slots in the patches, usually in combination with pins passing through the dielectric at very precise locations for short-circuiting the patches to the ground plane (once again, this rules out a coplanar feed). The specific case of a C-shape slot is discussed with the formation of a rectangular patch (no other shape is considered) connected to a conductive line surrounding it. It is stated several times that the patch and the line are connected in parallel which goes entirely against the present invention which distinguishes between a fed strip and a non-fed patch surrounded by the fed strip, the two being coupled electromagnetically. In this regard note that U.S. Pat. No. 4,771,291 is directed to making it possible to ignore the coupling effect.

It will be understood that the present invention lends itself very well to printed circuit implementation as it enables all feed lines, fed strips and non-fed (or parasitic) solid patches to be fabricated on one and the same side, with nothing passing through the dielectric. This is highly advantageous when a plurality of patches of the aforementioned type are disposed in an array.

In another aspect the invention resides in an array antenna formed by a plurality of elementary patches formed as a fed strip surrounding a solid patch from which it is separated by a closed loop slot, the patches being in series, in parallel or in a combined series/parallel configuration. An antenna of this kind lends itself particularly well to a severe overall size constraint such as $\Delta/\lambda_o<1$ or even $\Delta/\lambda_o<0.5$.

According to preferred features of the invention, some of which may be combinable:

- the ratio /e is between 1/5 and 5/1, l or e being at least approximately between 0.001 and 0.1 times the ratio $\lambda_o/\sqrt{\epsilon_c}$ where $\lambda_o$ is the wavelength at the operating frequency of the antenna and $\lambda_e$ is the effective dielectric constant of the propagation medium embodying the substrate and the patch;
- and/or e is at least approximately between 0.003 and 0.05 times the ratio $\lambda_o/\sqrt{\epsilon_c}$;
- the inner parasitic patch is circular and the conductive loop and the slot are concentric with it;
- the diameter of the inner parasitic patch is at least approximately 0.5 times the ratio $\lambda_o/\sqrt{\epsilon_c}$;
- the inner parasitic patch is polygonal;
- the inner parasitic patch is square;
- the side length of the inner length parasitic patch is at least approximately 0.5 times the ratio $\lambda_o/\sqrt{\epsilon_c}$;
- the feed line is coplanar with the patch.

Objects, features and advantages of the invention will emerge from the following description given by way of non-limiting example with reference to the appended drawings.

DETAILED DESCRIPTION OF THE PREFERRED EMBODIMENT

Figure 1:
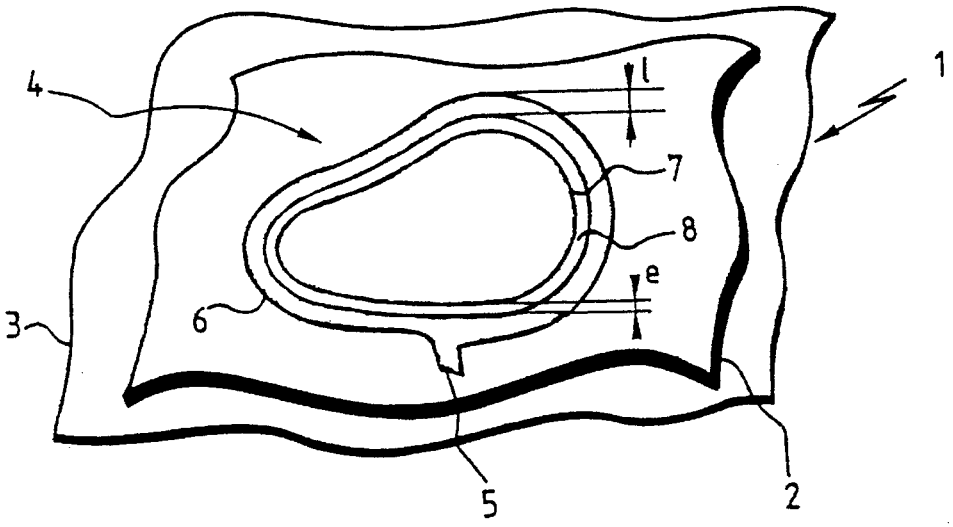
FIG. 1 is a diagrammatic perspective view of an elementary antenna patch in accordance with the invention.

FIG. 1 is a diagrammatic representation of an antenna element 1 in accordance with the invention.

The antenna element 1 embodies a dielectric substrate 2 on whose lower (or I) surface is a conductive metal layer 3 forming a ground plane and on whose upper (or S) surface is a microstrip patch 4 of conductive material connected to a feed line 5 which is preferably coplanar with the patch 4.

In practice the substrate 2 is homogeneous and of constant thickness.

In an alternative embodiment (not shown) the patch may be excited by direct contact with a cable passing through the substrate and insulated from the ground plane 3.

According to the invention, the patch 4 is formed to include a conductive loop 6 of constant width l surrounding a solid interior patch 7 which is insulated from (i.e. not connected to) the loop and whose outside edge follows the inside edge of the loop at a non-null constant distance e to form a continuous closed slot 8 of constant width e.

It will be understood that the inner patch 7 is not excited directly but is merely coupled to the inner loop: it therefore behaves as an inner parasitic patch.

In FIG. 1 this inner parasitic patch 7 can have any contour. In practice the shape is preferably a simple geometrical shape (circle, square, rectangle, polygon, possibly with rounded corners, ellipse, oval, etc).

To determine its dimensions, the patch 4 may be regarded as a conventional patch adapted to resonate at a required frequency (when it is excited) surrounded with a conductive loop which degrades its Q. In other words it widens the peak, i.e. it increases the bandwidth.

In other words the center frequency of the antenna element (or elementary antenna) 1 is defined by the shape and the size of the inner parasitic patch 7 and conventional sizing rules (equations or nomograms), for example those mentioned above in the aforementioned "Microstrip Antennas" by BAHL and BARTHIA.

The width e of the slot 8 is chosen to achieve strong coupling between the fed loop 6 and the parasitic patch 7. The width l of the conductive loop 6 is chosen in particular to enable good coupling via the slot 8 along all the latter's length.

The frequency response of the patch 4 depends of course on the exact dimensions chosen for the inner parasitic patch 7, the slot 8 and the loop 6. Depending on the antenna element specifications (or the specifications of an array antenna independent of the individual performance of the antenna elements) the final dimensions are determined by an iterative process starting with an arbitrary set of dimensions, for example.

For example, after determining the size of the inner parasitic patch 7 on the basis of the target center frequency (see above), the values and e may be chosen arbitrarily, provided that they conform to the conditions defined hereinabove, and if $\lambda_o$ is the wavelength at the center frequency and $\epsilon_e$ is the effective dielectric constant of the propagation medium that the antenna element constitutes (see above):

- the ratio l/e is between approximately 1/5 and 5/1 and
- l and/or e is at least approximately between 0.001 and 0.1 (preferably between 0.003 and 0.05) times the ratio $\lambda_o/\sqrt{\epsilon_c}$.

The behavior of the elementary antenna is dependent on how the loop 6 is electrically excited, especially its main polarization (which in practice is parallel to an imaginary line joining the feed point to a center point of the inner parasitic patch 7).

One skilled in the art will know how, starting from the theoretical dimensions, to optimize the dimensions to suit specific constraints of the target specification. For example, the optimization process to meet a given VSWR target (for example VSWR=2 or even 1.5) is one whereby the dimension is varied, in a manner that is known in itself, in such a way as to cause the largest possible part of the impedance curve for a given frequency range ($f_1$, $f_2$) of the antenna element (or the array antenna, as appropriate) to lie within a circle on the SMITH chart whose size is proportional to the required VSWR. The larger the part of the curve contained within the circle the greater the bandwidth.

Figure 2:
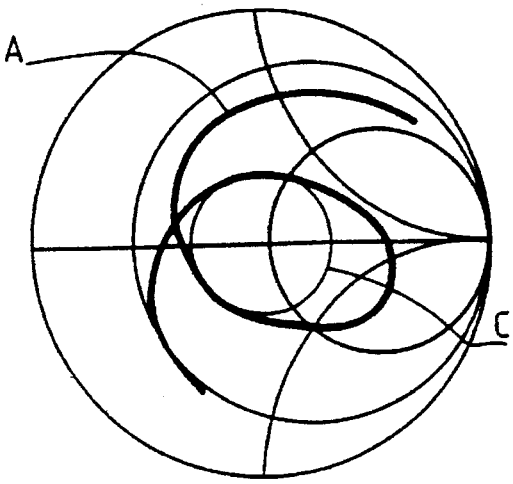
FIG. 2 is a curve of impedance as a function of frequency on a SMITH chart for an antenna as shown in FIG. 1 but not optimized.
Figure 3:
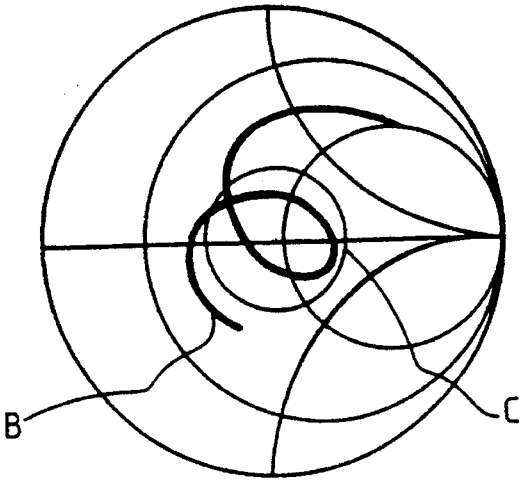
FIG. 3 is the impedance curve of the same antenna, also on a SMITH chart, but after optimization.

For example, the optimization process will lead from curve A in FIG. 2, which hardly intercepts the circle showing the target VSWR, to the curve B in FIG. 3 where an entire loop is contained within the circle C (on a SMITH chart each loop represents one resonance).

Figure 4:
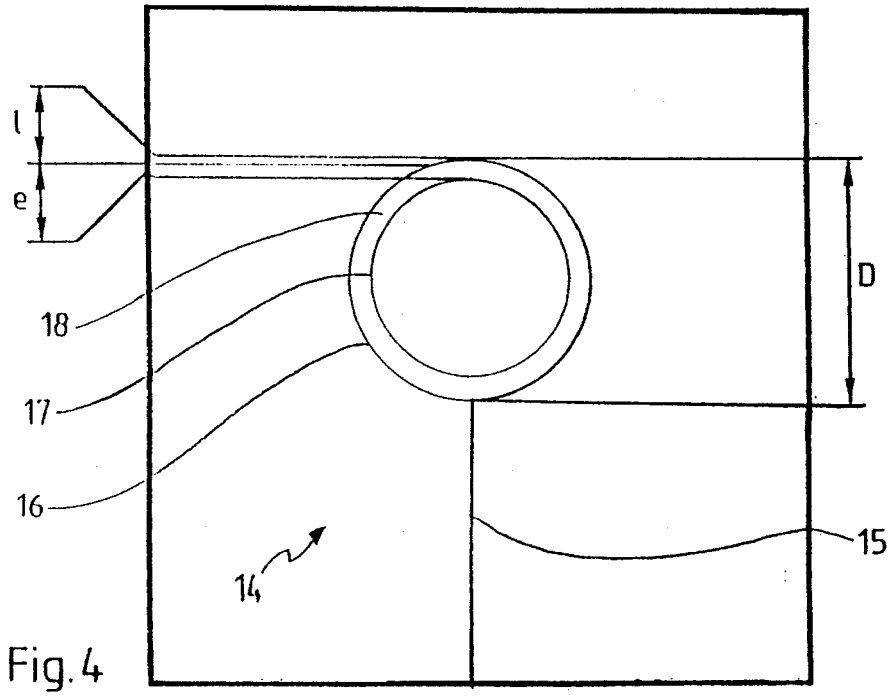
FIG. 4 shows a radiating patch as in FIG. 1 except that it is of circular shape.

FIG. 4 shows a patch 14 like the patch 4 from FIG. 1 except that it is circular: this patch 14 has an inner parasitic patch 17 separated from a surrounding circular loop 16 of diameter D by a circular slot 18.

The loop 16 is fed by a coplanar feed line 15.

For example, the dimensions of the patch may be chosen at the start of the iterative process using the following approximate (to within 20%, for example) formulas:

$$l = \lambda_o/(175 \cdot \sqrt{\epsilon_e})$$

$$e = \lambda_o/(87 \cdot \sqrt{\epsilon_e})$$

$$D = \lambda_o/(2 \cdot \sqrt{\epsilon_e})$$

These orders of magnitude reliably yield a first order sizing of the elements, i.e. a point of departure for iterative improvement.

As already stated, how the dimensions are optimized depends on the target performance, for example a VSWR constraint.

For example, in the case of a 2.28 mm thick dielectric substrate made from the TLX brand material marketed by the U.S. company TACONIC with a dielectric constant of 2.55, 35 μm thick copper ground plane and patches, optimizing the dimensions for a frequency in the range 2.3 GHz–2.4 GHz yielded these results:

l=0.5 mm e=1 mm

D=47 mm

In this example l=0.5e. Other tests have shown that satisfactory results can be obtained with other values, such as l=3e.

Figure 5:
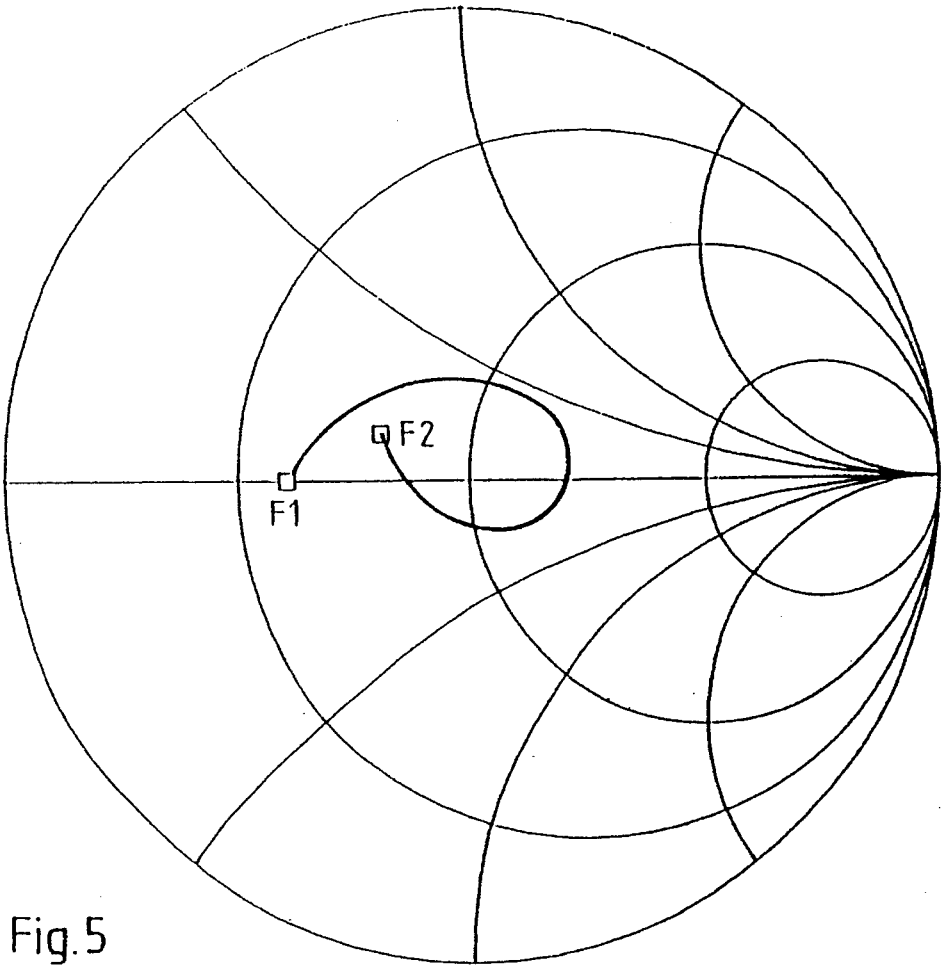
FIG. 5 shows the impedance curve on a SMITH chart of an antenna element as shown in FIG. 4 for the frequency range 2.3 GHz–2.4 GHz.

FIG. 5 shows the impedance curve obtained by this means between the points F1 and F2 (respectively 2.3 GHz and 2.4 GHz) after matching by means of a quarter-wavelength device of any appropriate known type (not shown), for example widening of the feed line adjacent its connection to the conductive loop over a distance $\lambda_o/(4.\sqrt{+e,rad}\ \epsilon_{e+ee})$.

Note that the frequency response is highly regular and homogeneous across all of the intended band (VSWR<2).

This shows that there is not a succession of resonances but rather a single resonance of "degraded" Q.

Figure 6:
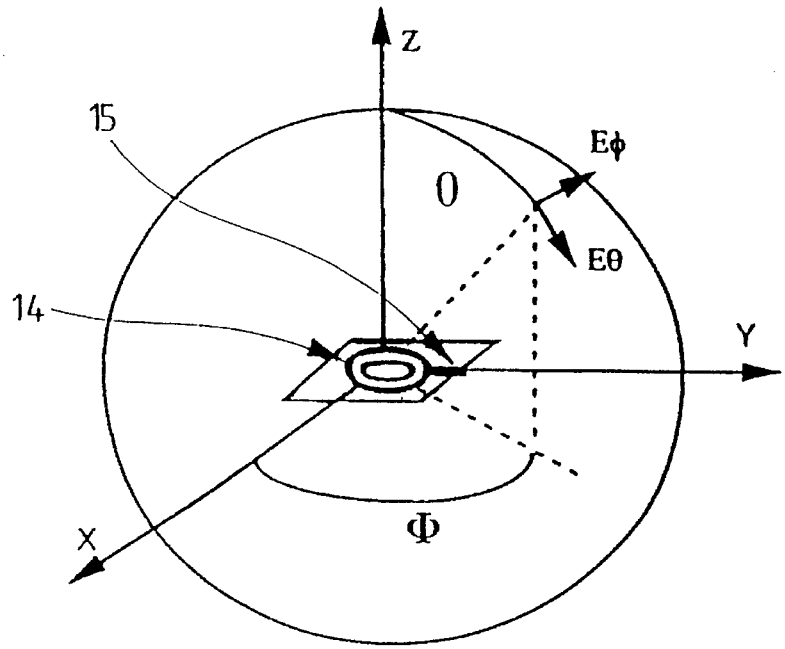
FIG. 6 shows a frame of reference associated with a patch antenna element as shown in FIG. 4 used to define the radiation diagram cross sections.

FIG. 6 shows a frame of reference associated with a patch antenna element as shown in FIG. 4 in which are defined the radiation diagram cross sections for FIGS. 7A through 7F, for $\phi$=0 and $\phi$=90° and frequencies of 2.3, 2.35 and 2.4 GHz, i.e. three frequencies in the intended frequency band.

These main cross sections of the radiation diagram measured at the center frequency of 2.35 GHz show that the diagram is at least comparable in terms of quality (stable hemispherical shape as a function of frequency) to the diagram of a conventional microstrip patch with a small bandwidth.

The FIG. 4 patch is therefore a good match to the requirements of the invention.

Figure 8:
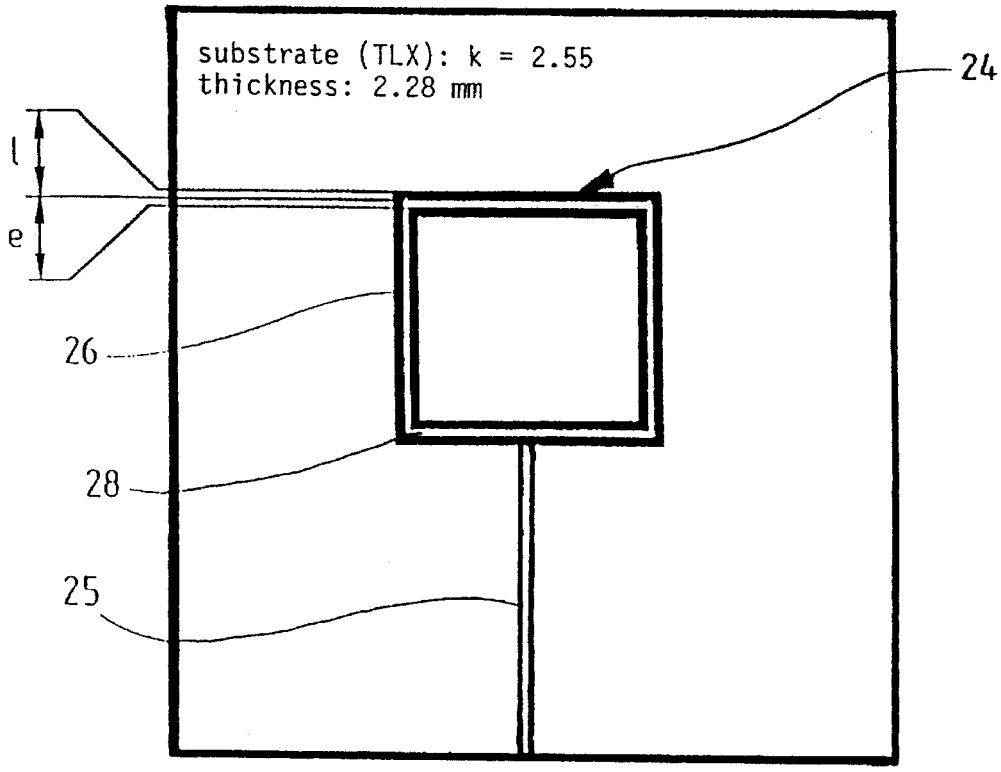
FIG. 8 shows a radiating patch as in FIG. 1 except that it is of square shape.
Figure 7A:
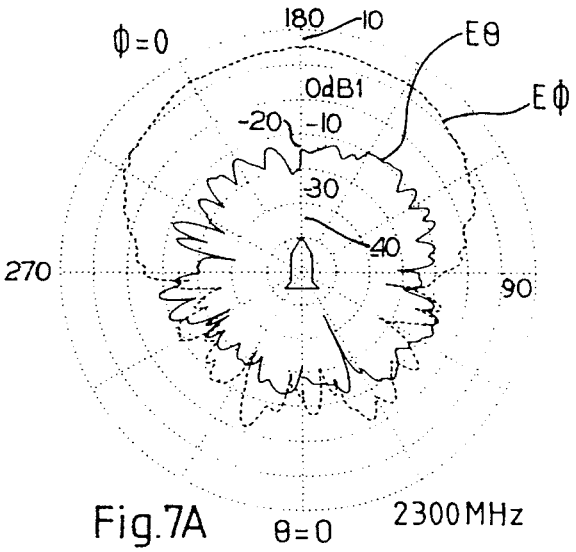
FIGS. 7A through 7F show the $\phi=0$ and $\phi=90°$ cross sections for frequencies of 2.3 GHz, 2.35 GHz and 2.4 GHz, respectively.
Figure 7B:
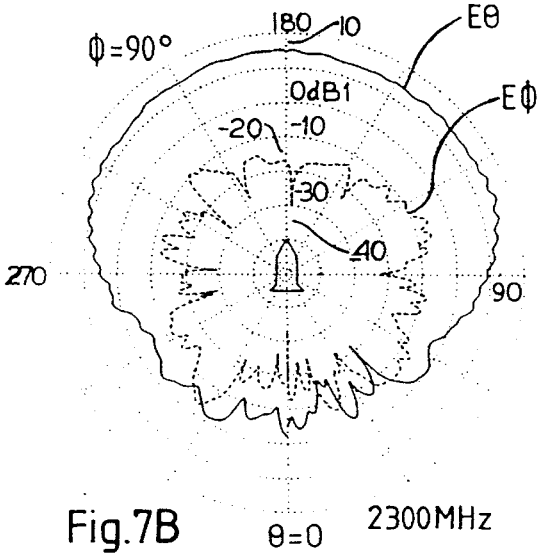
Figure 7C:
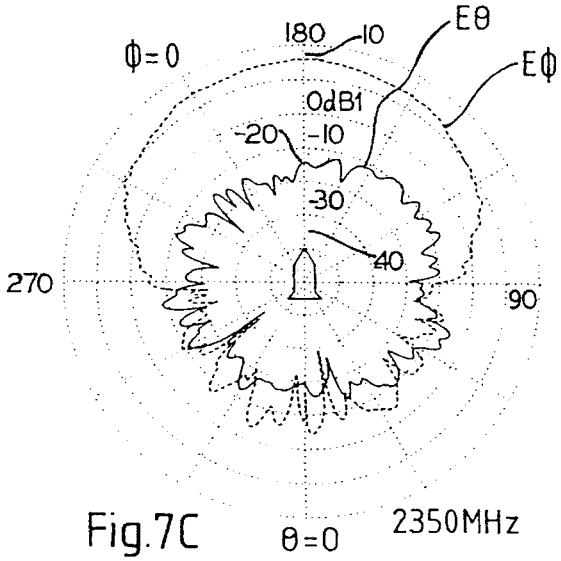
Figure 7D:
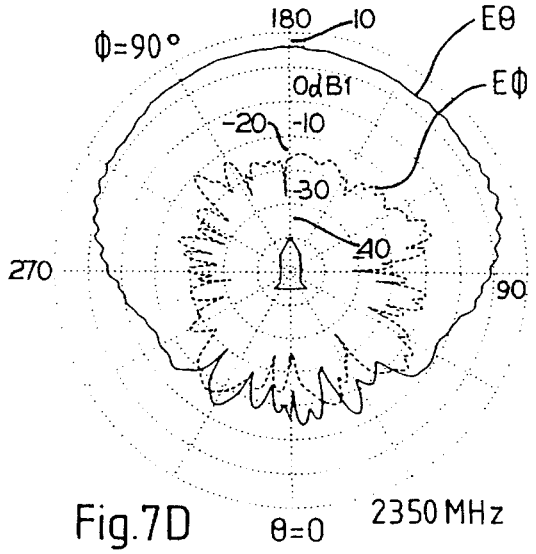
Figure 7E:
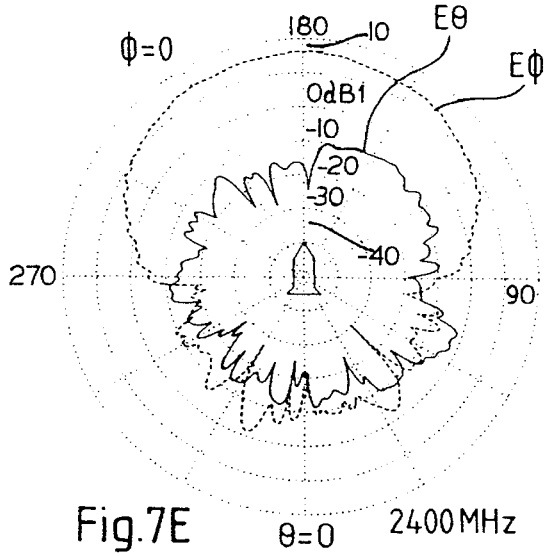
Figure 7F:
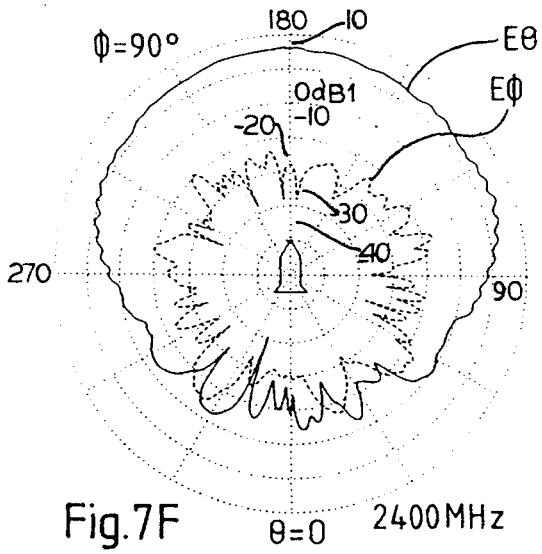

FIG. 8 shows a patch 24 comparable to that of FIG. 1 but square in shape. The patch 24 includes an inner parasitic patch 27 of length L separated from a square conductive loop 26 of width l surrounding it by a slot 28 of width e. The loop 26 is fed by a feed line 25.

With reference to the starting dimensions, the same rules are used as for the FIG. 4 patch, but substituting L for D, for example.

Acceptable performance was achieved with the following values:

l=1 mm e=0.5 mm

L=47 mm using the same materials as in the above circular patch example and for substantially the same range of frequencies.

A circular shape might seem preferable to a rectangular, square or even polygonal shape in that, in the case of high-power transmission, the corners are predisposed to electrical arcing which may destroy the antenna element locally.

As mentioned above, the invention is generally applicable to other shapes of inner parasitic patches such as polygonal, possibly with rounded corners, elliptical and oval shapes, among others.

It has already been mentioned that the sizing of the element depends on its future application.

If the element is to be used repetitively within an array, for example, the bandwidth of the array as a whole will depend on the bandwidth of the element, but will not necessarily be the same.

For example, if the distance between the (identical) elements of a parallel array is such that there is non-negligible coupling between patches, then the response of the array will differ from the response of each element taken individually. As a general rule the resonant loop of the array is found to be smaller than that of the element in isolation. In this case it is advisable to use an element having a slightly oversize resonant loop (like loop A in FIG. 2).

The senses of variation are as follows:

if 1 increases, e is constant, and if e increases, 1 is constant, then the observed effects are similar, i.e. the patch resonant loop becomes larger.

FIGS. 9 through 12B show the application of the elementary antenna concept described above to forming an array using the optimized element.

Figure 9:
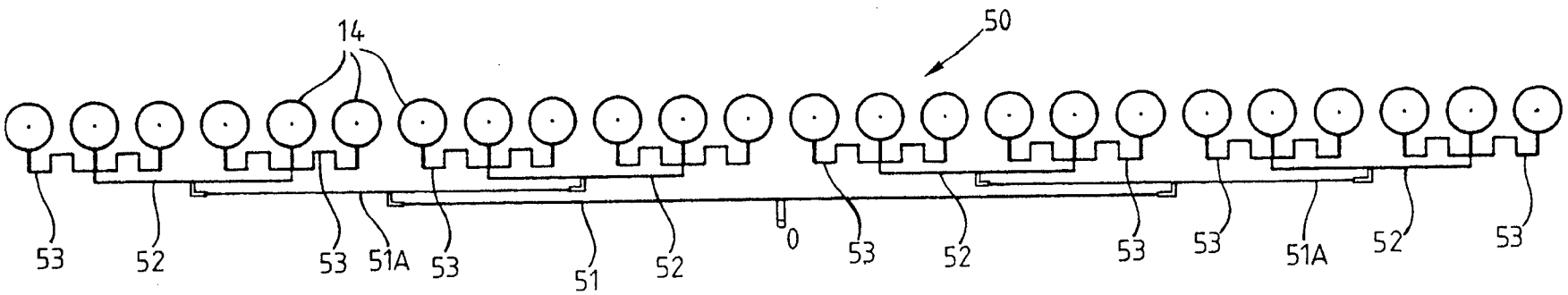
FIG. 9 shows an array antenna formed by an alignment of 24 identical antenna elements as shown in FIG. 4.

The FIG. 9 array is of the one-dimensional parallel type. This application is shown by way of non-limiting example only, however, and the element in accordance with the invention may equally well be used on a series type array or a two-dimensional array, either plane or conformed.

FIG. 9 shows an array antenna 50 formed by twenty-four (24) optimized elements 14 as shown in FIG. 4.

These twenty-four (24) elements are fed from a point O by an at least in part coplanar feed network embodying a divider by two (2) |51| feeding two other dividers by two (2) |51A| each feeding two dividers by two (2) |52| each feeding two dividers by three (3) |53|.

Figure 10B:
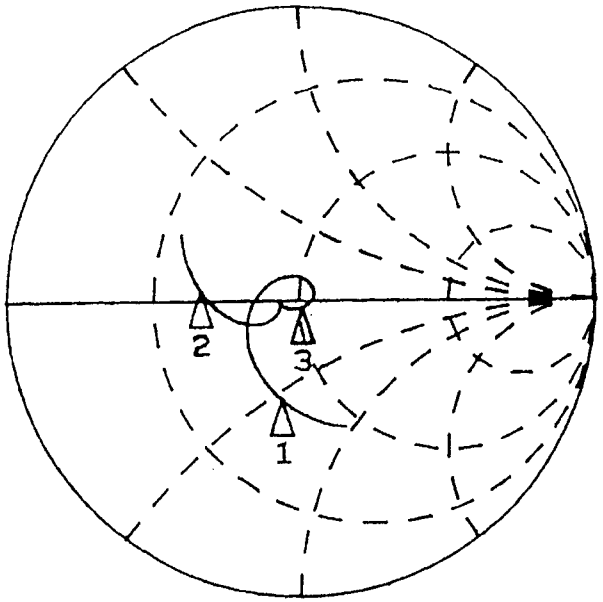
FIGS. 10A and 10B show the frequency response of the array antenna from FIG. 9 in a VSWR/frequency diagram and on a SMITH chart, respectively, for the frequency range 2.29 GHz–2.42 GHz.
Figure 10A:
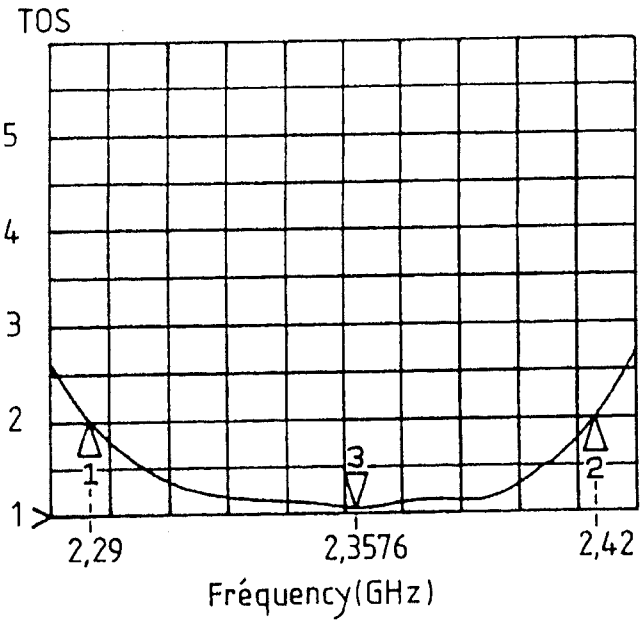

FIGS. 10A and 10B show the frequency responses of this array antenna 50. Frequencies 1, 2 and 3 are respectively 2.29 GHz, 2.42 GHz and 2.3576 GHz.

Note that the bandwidth for a VSWR below 2 is 115 MHz, which is 4.9% of the center frequency and greater than would be obtained with a conventional solid circular element of the same overall size.

Figure 11:
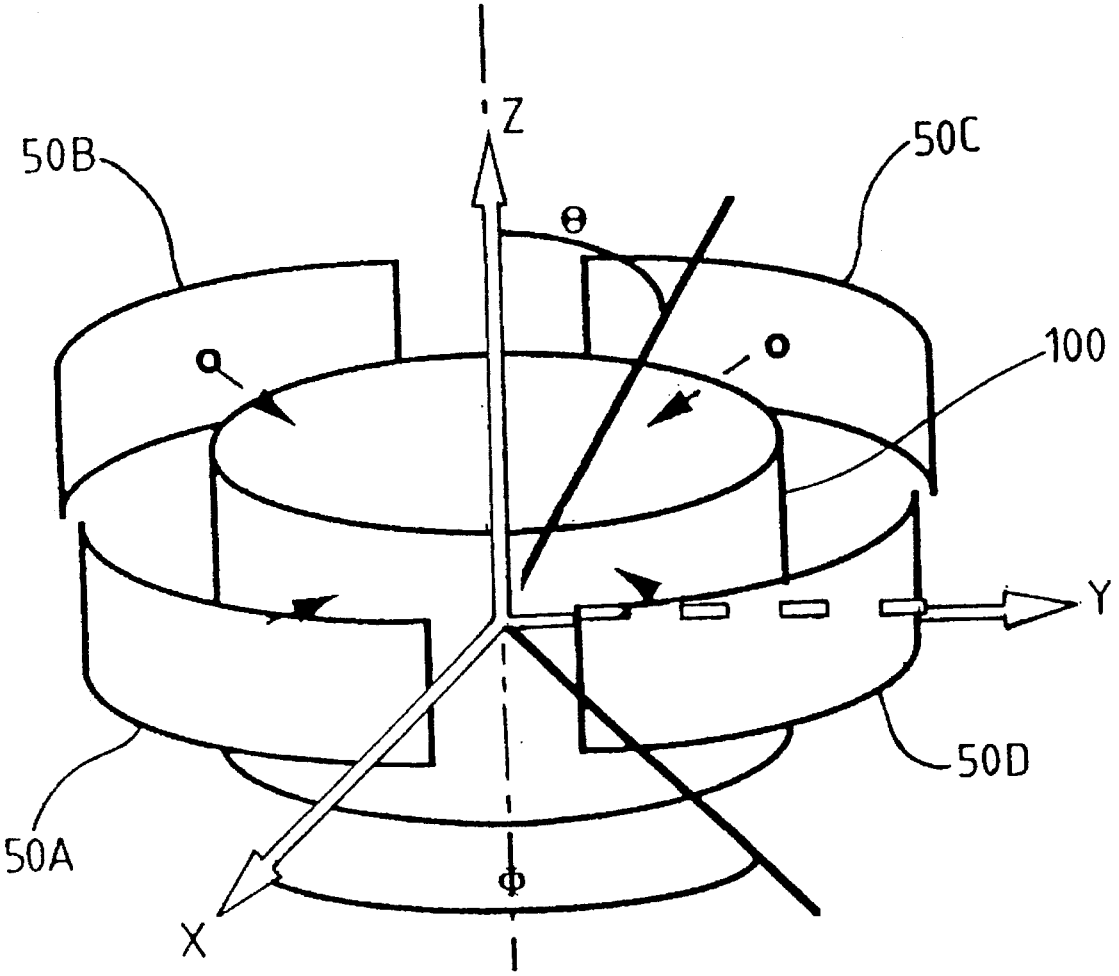
FIG. 11 is an exploded view of an array antenna around a cylindrical body and formed by four array antennas as shown in FIG. 10.

As shown in FIG. 11, several arrays 50A, 50B, 50C and 50D like that of FIG. 9 are then applied to a cylindrical structure so that the elements are uniformly and equally distributed over the structure at the same height, and the elements are fed with equal phase and equal amplitude to within a given tolerance.

This arrangement yields a highly omnidirectional radiation diagram, which is the objective in most telemetry applications. To optimize the radiation diagram the optimal number of elements may be calculated by software. This calculation usually yields a result close to that mentioned above, i.e. a distance between successive elements at most close to half the wavelength in air ($\Delta/\lambda_o<0.5$). The number of elements must also allow for the feed network and the associated constraints (power splitters, etc).

In the example shown in FIG. 11, which is for a frequency of 2 350 MHz, 96 elements (i.e. four arrays 50A, 50B, 50C and 50D) are disposed on a cylinder 100 with a radius equal to 1 meter. Each array 50A, 50B, 50C, and 50D requires three stages of dividers by two (2) and one stage of dividers by three (3) ($24=2^3\times3$) to feed the elementary patches.

The splitter stages for distributing the signals to the four sub-arrays are of the coaxial type. The other stages internal to the sub-arrays are of the microstrip type, incorporated into the coplanar feed as shown in FIG. 9.

FIG. 9 shows that the divider by three (3) has the following special feature: each branch of the divider is the same length to within $\lambda_o$. The median branch has any length 1 and the lateral branches have a length $L=1+\lambda_o$ where $\lambda_o$ is the wavelength in air at the center frequency of the wanted band (2 350 MHz in this case). The "equi-phase" character of the feed is no longer strictly adhered to. An error of ±12° is accepted over all of the wanted band.

This kind of consideration is evidently to be taken on its individual merits as appropriate to the type of application. For example, for a similar array on a 650 mm radius cylinder and at the same frequency the number of elements would be 64 and a feed array with six dividers by two (2) would be sufficient.

Thus the element as described lends itself very well to forming arrays with conventional constraints on the spacing between the radiating elements of the array.

Figure 12B:
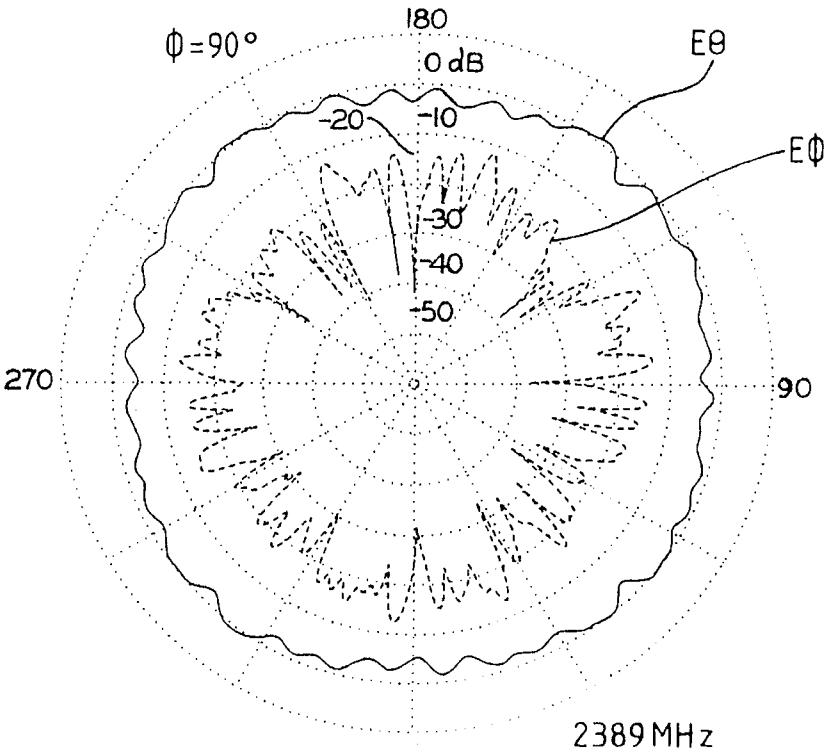
FIGS. 12A and 12B are $\phi=0$ and $\phi=90°$ cross sections in the frame of reference of FIG. 11 of the radiation diagram of the antenna from FIG. 11.
Figure 12A:
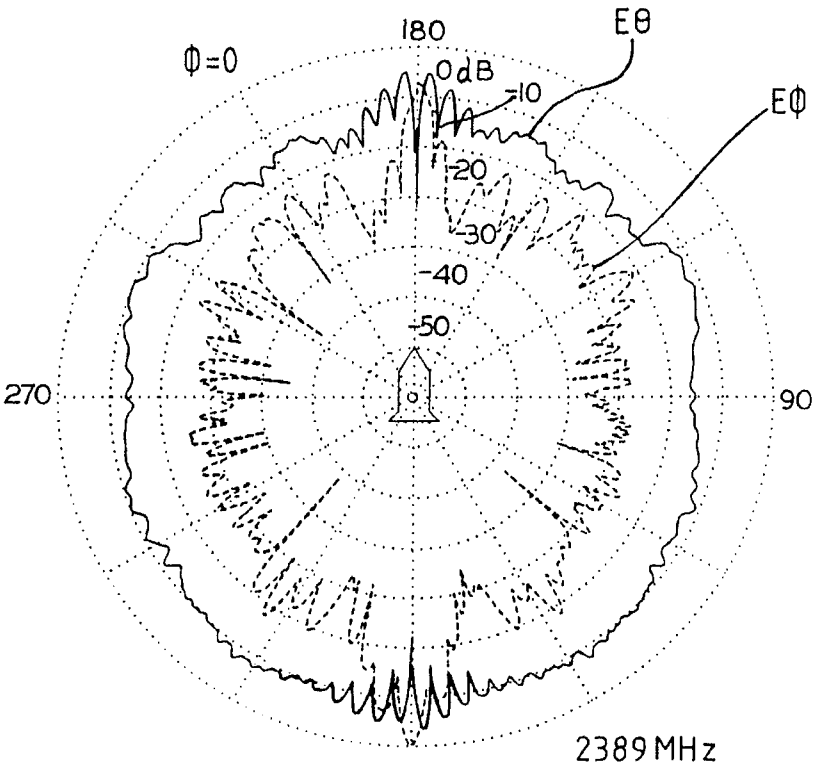

FIG. 12A and 12B show the $\phi=90°$ and $\phi=0°$ cross-sections of the radiation diagram of the cylindrical antenna measured in the FIG. 11 frame of reference.

Note that the diagram of the antenna is highly omnidirectional. The energy distribution of the radiation is highly homogeneous, as required with telemetry links.

The antennas described may be used, applied to a plane, or applied to a cylinder, for any telecommunication system. The above application was developed for a telemetry application from a mobile.

This concept lends itself particularly well to the application on a mobile because of the following properties:

the possibility of using a single dielectric layer (very simple antenna technology: no risk of layers separating and no problems with bonding or mechanical strength); and small thickness (conservation of aerodynamic characteristics).

It goes without saying that the preceding description has been given by way of non-limiting example only and that numerous variants may suggest themselves to one skilled in the art without departing from the scope of the invention.

What is claimed is:

1. An elementary antenna comprising:

a constant thickness dielectric substrate having a first side and a second side;

an electrically conductive microstrip feed line physically connected to said second side of said dielectric substrate;

a conductive metal layer forming a ground plane located on said first side of said dielectric substrate;

a radiating patch electrically connected to said feed line, said radiating patch being formed by only a single conductive loop of constant width (l);

an inner parasitic patch which is not energized, said radiating patch surrounding and separated from said inner parasitic patch and defining therebetween a closed continuous slot of constant width (e) adapted to bring about coupling between said conductive loop and said inner parasitic patch.

2. An elementary antenna according to claim 1 wherein a ratio of said width (l) of said conductive loop to said width (e) of said slot is between 1/5 and 5/1, said width l or said width e being at least approximately between 0.001 and 0.1 times a ratio $\lambda_o/\sqrt{\epsilon_e}$ wherein $\lambda_o$ is the wavelength of said elementary antenna at an operating frequency and $\epsilon_e$ is an effective dielectric constant of a propagation medium embodying said dielectric substrate.

3. An elementary antenna according to claim 2 wherein said width l of said connective loop and/or said width e of said slot is at least approximately between 0.003 and 0.05 times said ratio $\lambda_o/\sqrt{\epsilon_e}$.

4. An elementary antenna according to claim 2 wherein a diameter of said inner parasitic patch is at least approximately 0.5 times said ratio $\lambda_o/\sqrt{\epsilon_e}$.

5. An elementary antenna according to claim 1 wherein said inner parasitic patch is circular and said conductive loop and said slot are concentric with said inner parasitic patch.

6. An elementary antenna according to claim 1 wherein said inner parasitic patch is polygonal in shape.

7. An elementary antenna according to claim 1 wherein said inner parasitic patch is square in shape.

8. An elementary antenna according to claim 7 wherein the said length of said inner parasitic patch is at least approximately 0.5 times a ratio $\lambda_o/\sqrt{\epsilon_e}$ where $\lambda_o$ is the wavelength of said elementary antenna at an operating frequency and $\epsilon_e$ is an effective dielectric constant of a propagation medium comprising said dielectric substrate and said inner parasitic patch.

9. An elementary antenna according to claim 1 wherein said feed line is coplanar with said radiating patch.

10. An antenna array comprising a plurality of elementary antennas fed in series and in parallel, each elementary antenna of said plurality of elementary antennas embodying:

a constant thickness dielectric substrate having a first side and a second side;

an electrically conductive microstrip feed line physically connected to said second side of said dielectric substrate;

a conductive metal layer forming a ground plane located on said first side of said dielectric substrate;

a radiating patch electrically connected to said feed line, said radiating patch being formed by only a single conductive loop of constant width (1);

an inner parasitic patch which is not energized, said radiating patch surrounding and separated from said inner parasitic patch and defining therebetween a closed continuous slot of constant width (e) adapted to bring about coupling between said conductive loop and said inner parasitic patch.

11. An antenna array according to claim 10 further comprising a feed array which is at least in part coplanar with each conductive loop of each of said elementary antenna of said plurality of elementary antennas.

12. An antenna array according to claim 10 wherein each said elementary antenna is fed at the same phase and the same amplitude.

13. An antenna comprising:

a cylinder; and an annular series of equidistant elementary antennas disposed in a plane transverse to a longitudinal axis of said cylinder, each elementary antenna of said series of elementary antennas comprising:

a constant thickness dielectric substrate having a first side and a second side;

an electrically conductive microstrip feed line physically connected to said second side of said dielectric substrate;

a conductive metal layer forming a ground plane located on said first side of said dielectric substrate;

a radiating patch electrically connected to said feed line, said radiating patch being formed by only a single conductive loop of constant width l; and an inner parasitic patch which is not energized, said radiating patch surrounding and separated from said inner parasitic patch and defining therebetween a closed continuous slot of constant width e adapted to bring about coupling between said conductive loop and said inner parasitic patch.

* * * * *

UNITED STATES PATENT AND TRADEMARK OFFICE

CERTIFICATE OF CORRECTION

PATENT NO. : 5,565,875

DATED : October 15, 1996

INVENTOR(S) : Buralli et al

It is certified that error appears in the above-indentified patent and that said Letters Patent is hereby corrected as shown below:

Column 1, line 17, after "media" insert ---- , ----.

Column 1, line 19, after "example" insert ---- , ----.

Column 2, line 20, delete "Θ" insert ---- ϕ ----.

Column 2, line 66, delete "BANL" insert ---- BAHL ----.

Column 4, line 49, after "thickness," insert ---- paragraph indentation----.

Column 5, line 54, after ";" insert ---- and ----.

Column 6, line 12, after ";" insert ---- and ----.

Column 7, line 5, delete "/e" insert ---- l/e ----.

Column 6, line 22, after "width" insert ---- l ----.

Column 7, line 11, before "and/or" insert ---- l ----.

Column 7, line 21, after ";" insert ---- and ----.

Column 7, line 44, delete "." insert ---- ; ----.

Column 7, line 59 after ";" insert ---- and ----.

UNITED STATES PATENT AND TRADEMARK OFFICE

CERTIFICATE OF CORRECTION

PATENT NO. : 5,565,875

DATED : October 15, 1996

INVENTOR(S) : Buralli et al

It is certified that error appears in the above-indentified patent and that said Letters Patent is hereby corrected as shown below:

Column 8, line 52, after "values" insert ---- l ----.

Column 8, line 57, after "5/1" insert ---- , ----.

Column 9, line 55, delete "$\lambda_o/(4.\sqrt{+e,rad\ \varepsilon_{e+ee}})$" insert ---- $\lambda_0/(4.\sqrt{\varepsilon_e})$ ----.

Column 10, line 18, after "mm" insert ---- paragraph indentation ----.

Column 10, line 45, delete "1" insert ---- l ----.

Column 10, line 46, delete "1" insert ---- l ----.

Column 10, line 57, after "elements" insert --(patches)--

Column 10, line 60, delete "l51l" insert ---- 51 ----.

Column 10, line 61, delete "l51Al" insert ---- 51A ----, same line delete "l52l" insert ---- 52 ----.

Column 10, line 62, delete "l53l" insert ---- 53 ----.

Column 11, line 6, remove "paragraph indentation".

Column 11, line 8, remove "paragraph indentation".

UNITED STATES PATENT AND TRADEMARK OFFICE

CERTIFICATE OF CORRECTION

PATENT NO. : 5,565,875

DATED : October 15, 1996

INVENTOR(S) : Buralli et al

It is certified that error appears in the above-indentified patent and that said Letters Patent is hereby corrected as shown below:

Column 11, line 32, delete "1" insert ---- l ----.

Column 12, line 13, after ";" insert ---- and ----.

Column 12, line 27, delete "embodying" insert ---- comprising ----.

Column 12, line 29, delete "connective" insert ---- conductive ----.

Column 12, line 43, delete "said" (1st occurrence) insert --side--.

Column 12, line 53, delete "embodying" insert ---- comprising ----.

Column 12, line 64, delete "(1)" insert ---- (l) ----.

Signed and Sealed this

Fourteenth Day of October, 1997

*Attest:*

*Attesting Officer*

BRUCE LEHMAN

*Commissioner of Patents and Trademarks*